US007027021B2

(12) United States Patent
Cho

(10) Patent No.: US 7,027,021 B2
(45) Date of Patent: Apr. 11, 2006

(54) LIQUID CRYSTAL DISPLAY CONTROL DEVICE AND METHOD OF PREPARING PATTERNS FOR THE SAME DEVICE

(75) Inventor: Shouto Cho, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 330 days.

(21) Appl. No.: 10/408,564

(22) Filed: Apr. 8, 2003

(65) Prior Publication Data

US 2003/0218592 A1 Nov. 27, 2003

(30) Foreign Application Priority Data

Apr. 9, 2002 (JP) ..... 2002-106918

(51) Int. Cl.
*G09G 3/36* (2006.01)

(52) U.S. Cl. ..... 345/89; 345/87

(58) Field of Classification Search ..... 345/87, 345/88, 89, 63, 147, 148, 204, 690
See application file for complete search history.

(56) References Cited

U.S. PATENT DOCUMENTS 4,364,089 A * 12/1982 Woolfson ..... 348/169
6,043,801 A * 3/2000 Bassetti ..... 345/89
6,091,386 A * 7/2000 Bassetti et al. ..... 345/87
6,175,355 B1 * 1/2001 Reddy ..... 345/691
6,295,041 B1 * 9/2001 Leung et al. ..... 345/89
6,295,045 B1 9/2001 Furuhashi et al. ..... 345/99
6,862,021 B1 * 3/2005 Kudo et al. ..... 345/204

FOREIGN PATENT DOCUMENTS

JP 2000-214815 8/2000
JP 2000-276113 10/2000

* cited by examiner

*Primary Examiner*—Vijay Shankar
*Assistant Examiner*—Nitin Patel
(74) *Attorney, Agent, or Firm*—Oblon, Spivak, McClelland, Maier & Neustadt, P.C.

(57) ABSTRACT

Disclosed is a liquid crystal display control device for making gradation display on a liquid crystal display panel using binary display patterns, comprising a memory section storing a plurality of pattern data items for a plurality of gradation levels, each of the pattern data items defining a plurality of binary display patterns set for a plurality of basic frames, and each of the binary display patterns being defined by a plurality of basic pixels, and a selector section selecting one of the pattern data items, which corresponds to a designated gradation level, wherein the number of the basic frames and the number of the basic pixels for each of the gradation levels are predetermined and depend on each of the gradation levels.

12 Claims, 7 Drawing Sheets

| | | | |
|---|---|---|---|
| 0,0 | 0,1 | 0,2 | 0,3 |
| 1,0 | 1,1 | 1,2 | 1,3 |
| 2,0 | 2,1 | 2,2 | 2,3 |
| 3,0 | 3,1 | 3,2 | 3,3 |

FIG. 2A

| | | | |
|---|---|---|---|
| 0,0 | 0,1 | 0,2 | 0,3 |
| 1,0 | 1,1 | 1,2 | 1,3 |

FIG. 2B

| | |
|---|---|
| 0,0 | 0,1 |
| 1,0 | 1,1 |

FIG. 2C

| | |
|---|---|
| 0,0 | 0,1 |

FIG. 2D

| | | | | | | | |
|---|---|---|---|---|---|---|---|
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 2,0 | 2,1 | 2,2 | 2,3 | 2,0 | 2,1 | 2,2 | 2,3 |
| 3,0 | 3,1 | 3,2 | 3,3 | 3,0 | 3,1 | 3,2 | 3,3 |
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 2,0 | 2,1 | 2,2 | 2,3 | 2,0 | 2,1 | 2,2 | 2,3 |
| 3,0 | 3,1 | 3,2 | 3,3 | 3,0 | 3,1 | 3,2 | 3,3 |

FIG. 3A

| | | | | | | | |
|---|---|---|---|---|---|---|---|
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 0,2 | 0,3 | 0,0 | 0,1 | 0,2 | 0,3 | 0,0 | 0,1 |
| 1,2 | 1,3 | 1,0 | 1,1 | 1,2 | 1,3 | 1,0 | 1,1 |
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 0,2 | 0,3 | 0,0 | 0,1 | 0,2 | 0,3 | 0,0 | 0,1 |
| 1,2 | 1,3 | 1,0 | 1,1 | 1,2 | 1,3 | 1,0 | 1,1 |

FIG. 3B

| | | | | | |
|---|---|---|---|---|---|
| 0,0 | 0,1 | 0,0 | 0,1 | 0,0 | 0,1 |
| 1,0 | 1,1 | 1,0 | 1,1 | 1,0 | 1,1 |
| 0,0 | 0,1 | 0,0 | 0,1 | 0,0 | 0,1 |
| 1,0 | 1,1 | 1,0 | 1,1 | 1,0 | 1,1 |
| 0,0 | 0,1 | 0,0 | 0,1 | 0,0 | 0,1 |
| 1,0 | 1,1 | 1,0 | 1,1 | 1,0 | 1,1 |

FIG. 3C

| | | | | | |
|---|---|---|---|---|---|
| 0,0 | 0,1 | 0,0 | 0,1 | 0,0 | 0,1 |
| 0,1 | 0,0 | 0,1 | 0,0 | 0,1 | 0,0 |
| 0,0 | 0,1 | 0,0 | 0,1 | 0,0 | 0,1 |
| 0,1 | 0,0 | 0,1 | 0,0 | 0,1 | 0,0 |
| 0,0 | 0,1 | 0,0 | 0,1 | 0,0 | 0,1 |
| 0,1 | 0,0 | 0,1 | 0,0 | 0,1 | 0,0 |

FIG. 3D

| | | | | | | | |
|---|---|---|---|---|---|---|---|
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 2,0 | 2,1 | 2,2 | 2,3 | 2,0 | 2,1 | 2,2 | 2,3 |
| 3,0 | 3,1 | 3,2 | 3,3 | 3,0 | 3,1 | 3,2 | 3,3 |
| 0,0 | 0,1 | 0,2 | 0,3 | 0,0 | 0,1 | 0,2 | 0,3 |
| 1,0 | 1,1 | 1,2 | 1,3 | 1,0 | 1,1 | 1,2 | 1,3 |
| 2,0 | 2,1 | 2,2 | 2,3 | 2,0 | 2,1 | 2,2 | 2,3 |
| 3,0 | 3,1 | 3,2 | 3,3 | 3,0 | 3,1 | 3,2 | 3,3 |

LIQUID CRYSTAL DISPLAY CONTROL DEVICE AND METHOD OF PREPARING PATTERNS FOR THE SAME DEVICE

CROSS-REFERENCE TO RELATED APPLICATIONS

This application is based upon and claims the benefit of priority from the prior Japanese Patent Application No. 2002-106918, filed Apr. 9, 2002, the entire contents of which are incorporated herein by reference.

BACKGROUND OF THE INVENTION

1. Field of the Invention

The present invention relates to a liquid crystal display control device and a method of preparing patterns for the same device.

2. Description of the Related Art

A frame modulation gradation display method has been known as the gradation display method of a matrix type liquid crystal display panel (LCD panel). According to the above frame modulation method, gradation display is possible on the LCD panel even if a single pixel only makes binary display (on display and off display). According to the frame modulation method, on display and off display are properly combined in the time axis direction, and thereby, pseudo gradation display is possible. For example, if a 16-gradation level image is displayed, 16 frames are set as one cycle, and on frame and off frame are determined in accordance with gradation level. As a result, a desired gradation is obtained as the mean value of 16 frames.

As described above, according to the frame modulation method, several frames are set as one cycle. For this reason, the number of gradation levels increases, and thereby, flicker conspicuously appears; as a result, display quality worsens. Thus, if the 16-gradation level image is displayed, a display pattern is formed using 4 horizontal direction pixels and 4 vertical direction pixels, that is, the total 4×4=16 pixels. By doing so, the display quality can be prevented from deteriorating.

The following is a description on memory capacity required for storing the above display pattern. For example, if the 16-gradation level image is displayed, the following memory capacity is required. The memory capacity is 4096 bits=16 (the number of pixels in a display pattern)×16 (the number of frames)×16 (the number of gradation levels). If a microcomputer having built-in memory performs display control, preferably, the number of bits for storing the display pattern is reduced as much as possible because the number of bits of the built-in memory is limited.

In the frame modulation method, the display pattern for each gradation level is not necessarily optimized. For this reason, there is a problem that display quality worsens.

As described above, conventionally, there are problems that the memory capacity for storing the display pattern becomes much, and the display pattern is not optimized.

BRIEF SUMMARY OF THE INVENTION

According to a first aspect of the present invention, there is provided a liquid crystal display control device for making gradation display on a liquid crystal display panel using binary display patterns, comprising: a memory section storing a plurality of pattern data items for a plurality of gradation levels, each of the pattern data items defining a plurality of binary display patterns set for a plurality of basic frames, and each of the binary display patterns being defined by a plurality of basic pixels; and a selector section selecting one of the pattern data items, which corresponds to a designated gradation level; wherein the number of the basic frames and the number of the basic pixels for each of the gradation levels are predetermined and depend on each of the gradation levels.

According to a second aspect of the present invention, there is provided a method of preparing binary display patterns used for making gradation display on a liquid crystal display panel, a plurality of the binary display patterns being set for a plurality of basic frames, and each of the binary display patterns being defined by a plurality of basic pixels, comprising: determining a darkest basic pixel in a basic frame; lighting the darkest basic pixel; obtaining a binary display pattern for the basic frame by repeating the determining a darkest basic pixel and the lighting the darkest basic pixel; determining whether binary display patterns for all basic frames satisfy a predetermined condition; performing, in a next basic frame, the determining a darkest basic pixel to the determining whether binary display patterns for all basic frames satisfy a predetermined condition, when it is not determined that the binary display patterns for all basic frames satisfy the predetermined condition; and determining the binary display patterns satisfying the predetermined condition as final binary display patterns, when it is determined that the binary display patterns for all basic frames satisfy the predetermined condition.

BRIEF DESCRIPTION OF THE SEVERAL VIEWS OF THE DRAWING

FIG. 2A to FIG. 2D are views each showing a basic pixel group according to an embodiment of the present invention;

FIG. 3A to FIG. 3D are views each showing an arrangement of the basic pixel group according to an embodiment of the present invention;

DETAILED DESCRIPTION OF THE INVENTION

Embodiments of the present invention will be described below with reference to the accompanying drawings.

(First Embodiment)

The following is a description on the case where a 16-gradation image is displayed on a matrix type liquid crystal display panel in which only binary display is made in a single pixel. If the 16-gradation image is displayed, there exist the total 17 gradation levels from the case where all pixels are off state (0 gradation level) to the case where all pixels are on state (16-th gradation level). In the embodiment, the 15-th gradation level (the case where 15 pixels are on state) is not used so that the total number of gradation levels becomes 16.

Figure 1:
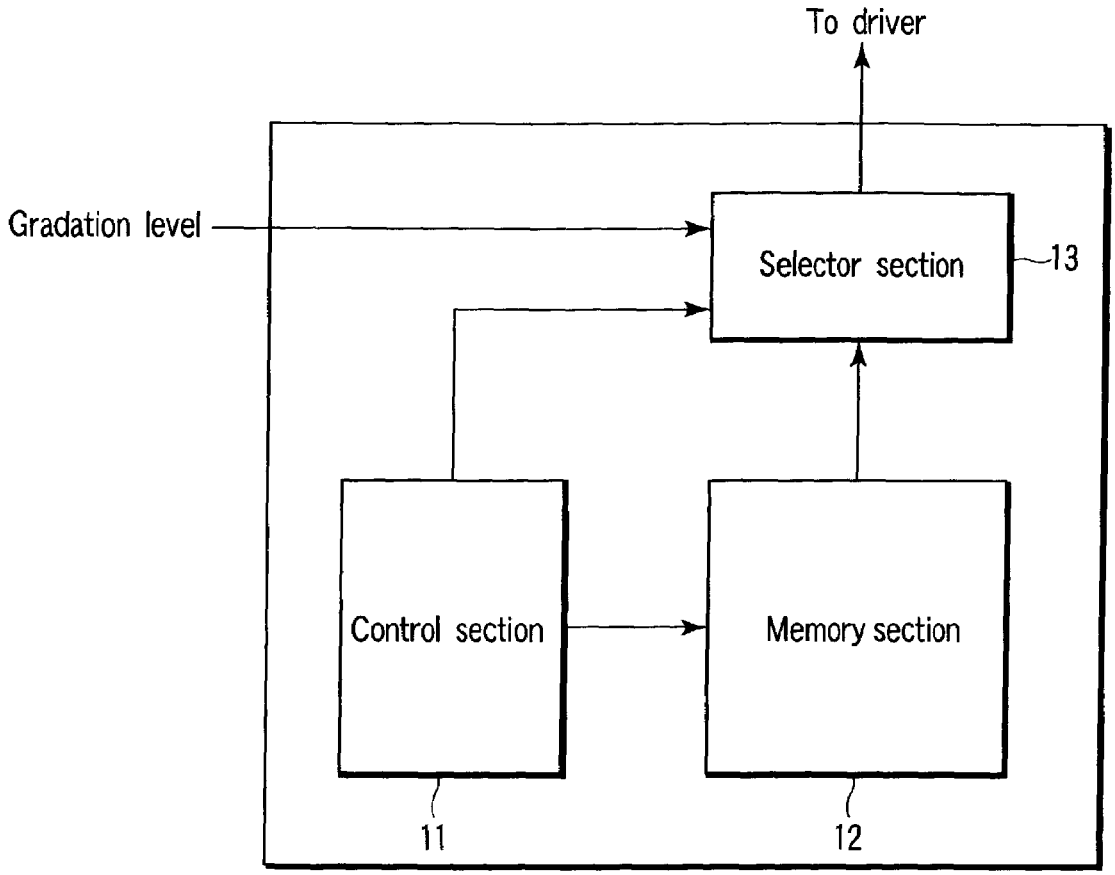
FIG. 1 is a block diagram showing the configuration of a liquid crystal display control device according to an embodiment of the present invention.

FIG. 1 is a block diagram showing the configuration of a liquid crystal display control device according to the first embodiment. The liquid crystal display control device includes a control section 11, a memory section (look-up table) 12, and a selector section 13. The memory section 12 stores binary display patterns (hereinafter, referred simply to display patterns) of each gradation level. The selector section 13 selects pattern data (set of display patterns) corresponding to the designated gradation level. The above constituent elements are built in a single IC chip.

In the first embodiment, the number of pixels (basic pixels) forming the display pattern is predetermined depending on gradation level. In addition, the number of display patterns (the number of basic frames) is predetermined depending on gradation level. For example, if the number of basic pixels is 4, one cycle includes 4 basic frames, and the number of basic frames is 4. More specifically, as shown in FIG. 2A to FIG. 2D, in the first, third, fifth, seventh, ninth, 11th and 13th gradation levels (hereinafter, referred to as first type) (see FIG. 2A), the basic pixel group is composed of 4×4=16 pixels, and the number of basic frames is 16. In the second, sixth, tenth and 14th gradation levels (hereinafter, referred to as second type)(see FIG. 2B), the basic pixel group is composed of 4×2=8 pixels, and the number of basic frames is 8. In the fourth and 12th gradation levels (hereinafter, referred to as third type) (see FIG. 2C), the basic pixel group is composed of 2×2=4 pixels, and the number of basic frames is 4. In the eighth gradation level (hereinafter, referred to as fourth type) (see FIG. 2D), the basic pixel group is composed of 2×1=2 pixels, and the number of basic frames is 2. In FIG. 2A to FIG. 2D, (i, j) shown in each pixel is each pixel position of X and Y directions in the basic pixel group.

FIG. 3A to FIG. 3D show the arrangement of each basic pixel group of the above first to fourth types. FIG. 3A to FIG. 3D show the first to fourth types, respectively.

Figure 4:
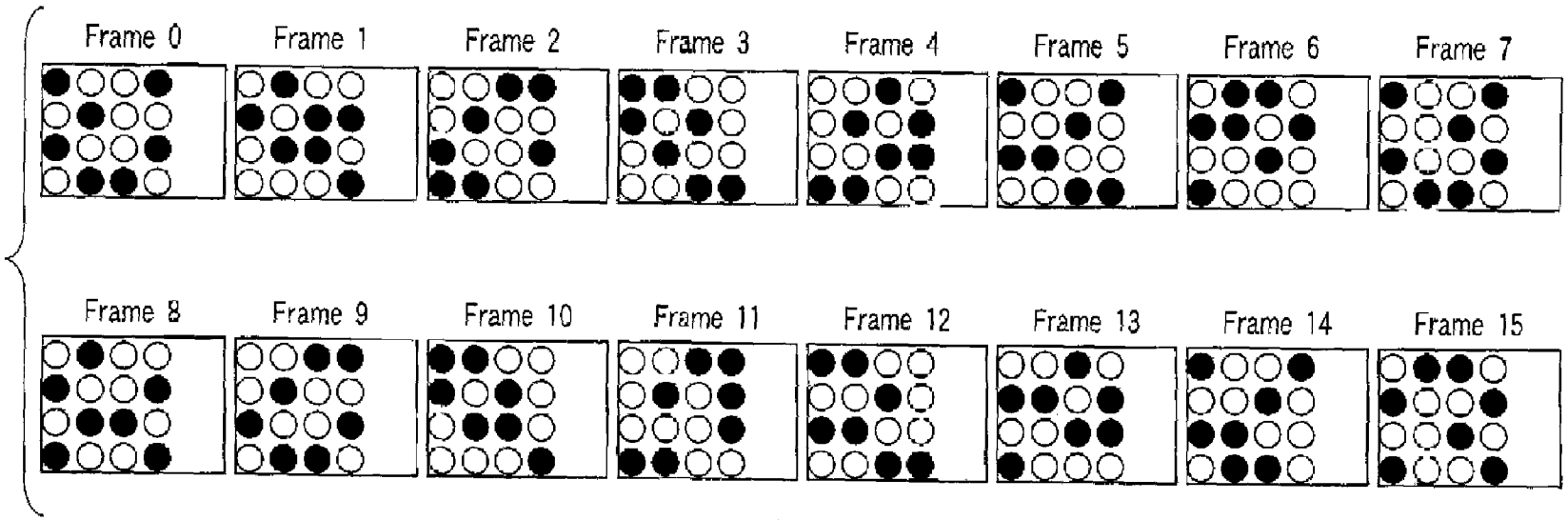
FIG. 4 is a view showing display patterns according to an embodiment of the present invention.

FIG. 4 shows display patterns of basic frames set for the seventh gradation level. As seen from FIG. 4, in each basic frame, seven pixels are on state. Any pixels included in the basic pixel group are on state in seven of 16 frames.

Here, the total memory capacity when the above method is employed is as follows. In the first type, the memory capacity is 1792 bits=16 (the number of pixels in a display pattern)×16 (the number of frames)×7 (the number of gradation levels). In the second type, the memory capacity is 256 bits=8 (the number of pixels in a display pattern)×8 (the number of frames)×4 (the number of gradation levels). In the third type, the memory capacity is 32 bits=4 (the number of pixels in a display pattern)×4 (the number of frames)×2 (the number of gradation levels). In the fourth type, the memory capacity is 4 bits=2 (the number of pixels in a display pattern)×2 (the number of frames)×1 (the number of gradation levels). Therefore, the total memory capacity is 2084 bits=1792+256+32+4. As a result, the total memory capacity is reduced to nearly half of the conventional memory capacity (4096 bits).

Pattern data can be used in common for gradation level expressed by (8−c) and gradation level expressed by (8+c). That is, each display pattern of the (8−c) gradation level is obtained by inverting each display pattern of the (8+c) gradation level (on display pixel is inverted to off display pixel, off display pixel is inverted to on display pixel). As described above, the pattern data is used in common, and thereby, the memory capacity can be further reduced. More specifically, in the first type, the pattern data of seventh and ninth gradation levels is used in common, the pattern data of fifth and 11th gradation levels is used in common, and the pattern data of third and 13th gradation levels is used in common, and thereby, the memory capacity is 1024 bits. In the second type, the pattern data of sixth and tenth gradation levels is used in common, and the pattern data of second and 14th gradation levels is used in common, and thereby, the memory capacity is 128 bits. In the third type, the pattern data of fourth and 12th gradation levels is used in common, and thereby, the memory capacity is 16 bits. In the fourth type, the memory capacity is 4 bits as already described. Therefore, the total memory capacity is 1172 bits=1024+128+16+4, so that the memory capacity can be greatly reduced.

Figure 5:
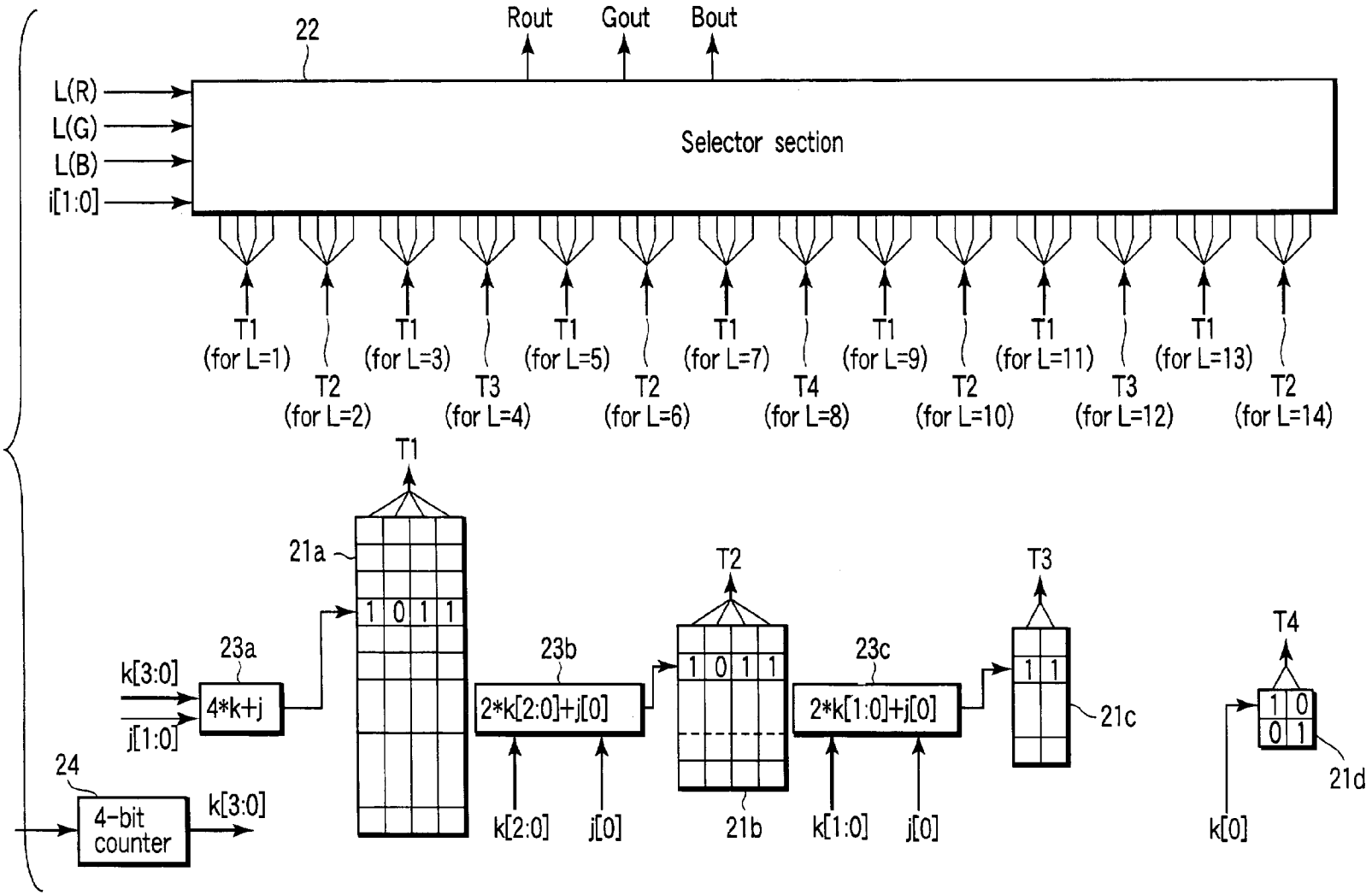
FIG. 5 is a view to explain the detailed configuration and operation of the liquid crystal display control device according to an embodiment of the present invention.

FIG. 5 is a view to explain the detailed configuration and operation of the liquid crystal display control device according to the first embodiment.

In FIG. 5, 21*a* to 21*d* correspond to a memory section (look-up table) storing display patterns. The 21*a* is a memory part storing display patterns of the first, third, fifth, seventh, ninth, 11th and 13th gradation levels (first type). The 21*b* is a memory part storing display patterns of the second, sixth, tenth and 14th gradation levels (second type). The 21*c* is a memory part storing display patterns of the fourth and 12th gradation levels (third type). The 21*d* is a memory part storing display patterns of the eighth gradation level (fourth type). A reference numeral 22 denotes a selector section for selecting the display pattern from the above memory parts 21*a* to 21*d*. Reference numerals 23*a* to 23*c* denotes operation parts, 24 denotes a 4-bit counter.

The 4-bit counter 24 inputs frame pulse, and outputs 4-bit count value k[3:0].

The operation part 23*a* inputs 4-bit count value k[3:0] and data j[1:0] expressing lower 2 bits of the Y coordinate value of the current pixel. The operation result (4×k+j) in the operation part 23*a* is outputted to the memory part 21*a* as address data. The memory part 21*a* outputs 4-bit data stored in the designated address.

The operation part 23*b* inputs lower 3-bit k[2:0] of the count value and lower 1 bit j[0] of the Y coordinate value. The operation result (2×k[2:0]+j[0]) in the operation part 23*b* is outputted to the memory part 21*b* as address data. The memory part 21*b* outputs 4-bit data stored in the designated address.

The operation part 23*c* inputs lower 2-bit k[1:0] of the count value and lower 1-bit j[0] of the Y coordinate value. The operation result (2×k[1:0]+j[0]) in the operation part 23*c* is outputted to the memory part 21*c* as address data. The memory part 21*c* outputs 4-bit data converted from 2-bit data stored in the designated address.

The memory part 21*d* inputs lower 1-bit k[0] of the count value as address data. The memory part 21*d* outputs 4-bit data converted from 2-bit data stored in the designated address.

According to the above operation, data of each gradation level L stored in the memory parts 21*a* to 21*d* is inputted to the selector section 22. In FIG. 5, for example, the first gradation level data of the first type is expressed as T1 (for L=1), and the second gradation level data of the second type is expressed as T2 (for L=2).

4-bit data expressing each gradation level of three primary colors (R gradation level L (R), G gradation level L (G), B gradation level L (B)), are inputted to the selector section 22 from the outside. In addition, lower 2-bit i[1:0] of the X coordinate value of the current pixel is inputted to the selector section 22. Based on the above data, 1-bit output data (Rout, Gout, Bout) of each primary color is successively outputted from the selector section 22. That is, if the gradation level belongs to the first to fourth types (i.e., first to 14th gradation levels), any one of data from the memory parts 21*a* to 21*d* is selected, and data selected by lower 2-bit i[1:0] of the X coordinate value is successively outputted. If the gradation level is 0-gradation level, off-display state data (logical value 0) is outputted. If the gradation level is the 16th gradation level, on-display state data (logical value 1) is outputted.

As seen from the above description, according to the first embodiment, the number of basic frames and the number of basic pixels are preset in accordance with the gradation level. By doing so, it is possible to greatly reduce the memory capacity for storing display patterns. Therefore, in particular, it is effective in the case where the microcomputer having built-in memory carries out the display control of the liquid crystal display panel.

The above embodiment has described the case of displaying image having the total gradation level number N of 16 (N=16). However, the total gradation level number N is not limited. For example, there exists gradation level expressed by (N/a)×b (where, a and N/a are an integer of 2 or more, b is an integer larger than 0 and smaller than a). In this case, the number of basic frames and the number of basic pixels are both set as a; therefore, the memory capacity can be effectively reduced. In addition, if the total gradation level number N is expressed by $n^2$ (where, n is an integer of 2 or more), the basic pixel group is composed of n×n (X-direction n pixels, Y-direction n pixels), so that deterioration of display quality can be prevented. If $n^2$ is an odd number, it is preferable that the total gradation level number N is $N=n^2+1$. When the pattern data is used in common, c is set as an integer larger than 0 and smaller than N/2, it is preferable that common pattern data is used for gradation level expressed by c and gradation level expressed by N−c.

(Second Embodiment)

The following is a description on the method of obtaining the optimal display pattern in each gradation level. Matters overlapping with those described in the first embodiment are omitted.

Figures 6, 7:
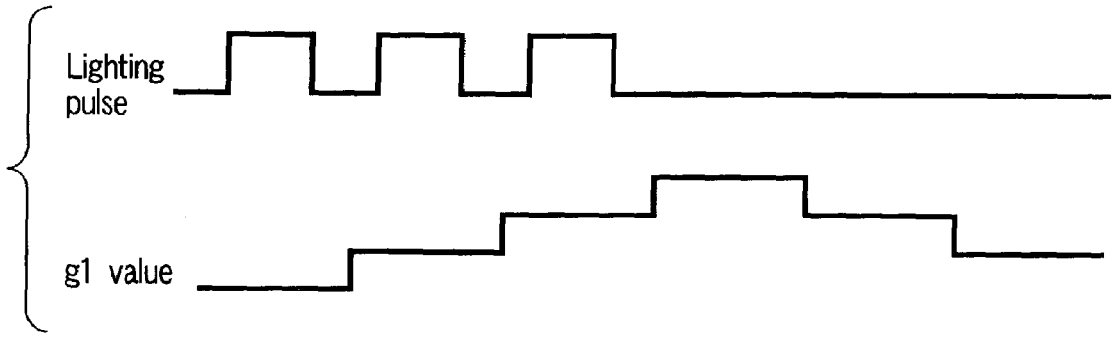
FIG. 6 is a view showing an arrangement of the basic pixel group according to an embodiment of the present invention.
FIG. 7 is a view showing a brightness change of pixel according to an embodiment of the present invention.

FIG. 6 shows an arrangement of the basic pixel group for the first, third, fifth, seventh, ninth, 11th and 13th gradation levels (first type). The following is a description on the brightness of the central pixel, for example, a pixel (0, 0) shown in the circle of FIG. 6. The actual brightness of the central pixel receives the influence by the brightness of surrounding pixels, in addition to the self-brightness thereof. For instance, the self-brightness of pixel (i, j) is set as g1[j][i], and the actual brightness of pixel (i, j) receiving the influence by the brightness of surrounding pixels is set as g2[j][i]. In this case, g2[j][i] can be expressed by the following equation (1).

$$g2[j][i] = g1[C(j)][C(i)] + (g1[C(j)][C(i+1)] + g1[C(j)][C(i-1)] + g1[C(j+1)][C(i)] + g1[C(j-1)][C(i)])/(Kc(2)) + 2.0*(g1[C(j)][C(i+2)] + g1[C(j+2)][C(i)])/(Kc(4)) + (g1[C(j)][C(i+3)] + g1[C(j)][C(i-3)] + g1[C(j+3)][C(i)] + g1[C(j-3)][C(i)])/(Kc(6)) + (g1[C(j+1)][C(i+1)] + g1[C(j+1)][C(i-1)] + g1[C(j-1)][C(i+1)] + g1[C(j-1)][C(i-1)])/(Kc(sqrt(8))) + \tag{1}$$

-continued $$4.0*g1[C(j+2)][C(i+2)]/(Kc(sqrt(32))) + 2.0*(g1[C(j+1)][C(i+2)] + g1[C(j-1)][C(i+2)] + g1[C(j+2)][C(i+1)] + g1[C(j+2)][C(i-1)])/(Kc(sqrt(20)))$$

Where, $Kc(r2/r1)=(r2/r1)^r$ $(1.5 \leqq r \leqq 2.5)$

In the above equation (1), r1 is a radius when on-pixel (lighting pixel) is assumed as being a sphere, and r2 is a distance from on-pixel. The value of r is theoretically 2. C(i) means "i mod 4", for example, C(1)=C(5)=C(−3). The above "sqrt" means square root.

The brightness of a certain frame of a certain pixel receives the influence of the frame before it. For example, as shown in FIG. 7, when a certain pixel continuously becomes on state, the brightness of the certain pixel gradually increases. Assuming that the brightness of a certain frame of a certain pixel is set as g1(j,i), the brightness g1(j,i)next of the nest frame is expressed by the following equation (2).

$$g1(j,i)\text{next}=g1(j,i)*(1-Kr)+Kr*Ps(j,i) \tag{2}$$

Where, $0.05 \leqq Kr \leqq 0.2$, and in general, Kr=0.1. Ps(j,i) is 1 if pixel is on state while being 0 if pixel is off state.

Figure 8:
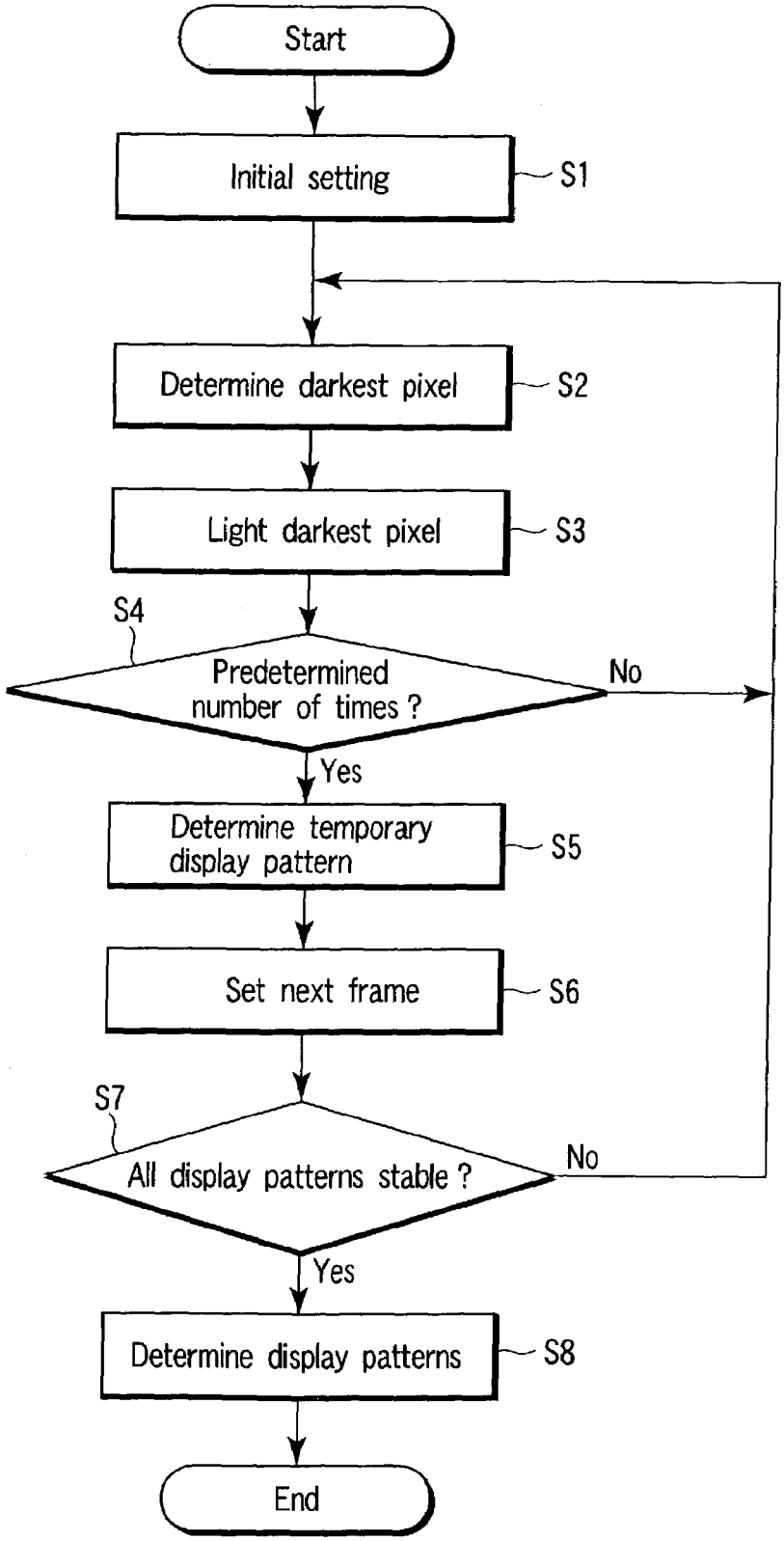
FIG. 8 is a flowchart showing a method of obtaining the optimal display pattern according to an embodiment of the present invention.

The method of obtaining the optimal display pattern will be described below with reference to the flowchart shown in FIG. 8. Here, the case of obtaining the display pattern of the seventh gradation level shown in FIG. 4 will be described.

In step S1, the initial setting is made. That is, the number of basic frames is set to 16, the number of pixels included in the basic pixel group is set to 16, and the number of on-pixels in the basic pixel group is set to 7. In addition, a pixel, which first becomes on state, is temporarily set in the basic pixel group of the first frame. In this case, the pixel is on state, that is, g1(0,0)=1; on the other hand, other pixels are off state, that is, g1(j,i)=0.

In step S2, of the basic pixel group of the current basic frame, the darkest pixel (i.e., pixel having the lowest brightness) at that time is determined as on-pixel. Based on the above equation (1), the values of g2(j,i) $(0 \leqq i \leqq 3, 0 \leqq j \leqq 3)$ of all basic pixels included in the current basic pixel group are calculated. The darkest pixel (Jmin, Imin) of the basic pixels is determined.

In step S3, the pixel (Jmin, Imin) determined in the above step S2 is set to on state. Then, g1(Jmin, Imin)next is set using the following equation based on the above equation (2).

$$g1(Jmin,Imin)\text{next}=g1(Jmin,Imin)+Kr*Ps(Jmin,Imin)$$

In step S4, it is determined whether or not the procedures of steps S2 and S3 are carried out at the predetermined number of times (seven time). In other words, a decision is made whether or not all of seven on-pixels are determined in the currently selected basic pixel group. If a decision is made that all on-pixels are not determined, the process sequence returns to step S2, and a pixel to be on next is determined. If a decision is made that all on-pixels are determined, the operation sequence proceeds to step S5. In step S5, the pattern of the determined seven on-pixels is determined as a temporary display pattern.

In step S6, the next basic frame is set. That is, g1(j,i)next values are determined with respect to all basic pixels included in the basic pixel group using the following equation based on the above equation (2).

$$g1(j,i)\text{next}=g1(j,i)*(1-Kr)$$

In step S7, it is determined whether or not the determined temporary display patterns of all basic frames (16 frames) are stable. More specifically, the finally determined display pattern is compared with the display pattern determined before it (before 16 frame) in each basic frame. If an error based on the comparative result is less than a predetermined value, the display patterns (temporary display patterns) are regarded as being stable in all of 16 frames. On the other hand, if it is determined in step S7 that the display patterns are not stable, the operation sequence returns to step S2, and the operation of the next frame is carried out.

In step S7, if it is determined that the display patterns are stable, the operation sequence proceeds to step S8. In step S8, the determined temporary display patterns of 16 frames are determined as the final display patterns. The final display patterns thus determined are stored in the memory section of the liquid crystal display control device.

The above operation will be described with reference to FIG. 4. In each of 0 to 15th frames, display pattern (that seven pixels are on state) is temporarily determined. Thereafter, the operation to the next 0 to 15th frames is carried out. That is, considering the influence of display patterns temporarily determined so far, each display pattern of the 0 to 15th frames is successively updated. The updated display pattern is successively determined as a temporary display pattern. Therefore, when the temporary display pattern is determined in each frame, display patterns (that seven pixels are on state) are obtained in all of 0 to 15th frames. In other words, every when the temporary display pattern is determined in each frame, the decision of step S7 is made.

As described above, according to the second embodiment, the optimal display pattern is determined using the principle of determining the darkest pixel (having the lowest brightness) at that time, and making (lighting) the pixel on state. When gradation display is performed in a state that on pixels and off pixels are dispersed in time and space, human's eye recognize preferable image on its characteristics when on pixels are further dispersed. The method of the second embodiment is employed, and thereby, the on pixels can be effectively dispersed in time and space, and the optimized display pattern can be obtained. In addition, in the second embodiment, the operation is repeated until the display pattern of each frame stabilizes; therefore, the display pattern can be very accurately determined.

The second embodiment has described the case of determining the display pattern of the seventh gradation level when the total gradation level number N is 16. Likewise, the method of the second embodiment is applicable to other gradation levels. The total gradation level number N is not limited to 16, and the method of the second embodiment is applicable to various total gradation level numbers described in the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display control device for making gradation display on a liquid crystal display panel using binary display patterns, comprising:

a memory section configured to store a plurality of pattern data items for a plurality of gradation levels, each of the pattern data items defining a plurality of binary display patterns set for a plurality of basic frames, and each of the binary display patterns being defined by a plurality of basic pixels; and a selector section configured to select one of the pattern data items, which corresponds to a designated gradation level, wherein the number of the basic frames and the number of the basic pixels for each of the gradation levels are predetermined and depend on each of the gradation levels, and wherein the number of the basic frames and the number of the basic pixels are equal to each other in each gradation level.

2. The device according to claim 1, wherein the number of gradation levels of an image to be displayed on the liquid crystal display panel is N, and the number of the basic frames and the number of the basic pixels are a in a gradation level expressed by $(N/a)\times b$, where a is an integer of 2 or more, N/a is an integer of 2 or more, and b is an integer larger than 0 and smaller than a.

3. The device according to claim 2, wherein the number of the basic frames and the number of the basic pixels are N in a gradation level incapable of being expressed by $(N/a)\times b$.

4. The device according to claim 1, wherein the number of gradation levels of an image to be displayed on the liquid crystal display panel is $n^2$, where n is an integer of 2 or more and $n^2$ is an even number.

5. The device according to claim 1, wherein the number of gradation levels of an image to be displayed on the liquid crystal display panel is $n^2+1$, where n is an integer of 2 or more and $n^2$ is an odd number.

6. The device according to claim 1, wherein the number of gradation levels of an image to be displayed on the liquid crystal display panel is N, and common pattern data item is used for a gradation level expressed by c and for a gradation level expressed by N−c, where c is an integer larger than 0 and smaller than N/2.

7. A method of preparing binary display patterns used for making gradation display on a liquid crystal display panel, a plurality of the binary display patterns being set for a plurality of basic frames, and each of the binary display patterns being defined by a plurality of basic pixels, comprising:

determining a darkest basic pixel in a basic frame;

lighting the darkest basic pixel;

obtaining a binary display pattern for the basic frame by repeating said determining a darkest basic pixel and said lighting the darkest basic pixel;

determining whether binary display patterns for all basic frames satisfy a predetermined condition;

performing, in a next basic frame, said determining a darkest basic pixel to said determining whether binary display patterns for all basic frames satisfy a predetermined condition, when it is not determined that the binary display patterns for all basic frames satisfy the predetermined condition; and determining the binary display patterns satisfying the predetermined condition as final binary display patterns, when it is determined that the binary display patterns for all basic frames satisfy the predetermined condition.

8. The method according to claim 7, wherein the number of the basic frames and the number of the basic pixels are equal to each other.

9. The method according to claim 7, further comprising:

storing the final binary display patterns in a memory section of a liquid crystal display control device.

10. The method according to claim 7, wherein determining the darkest basic pixel includes reflecting an influence of basic pixels lighted so far.

11. A liquid crystal display control device comprising a memory section storing the final binary display patterns obtained by the method according to claim 7.

12. A liquid crystal display control device for making gradation display on a liquid crystal display panel using binary display patterns, comprising:

a memory section configured to store a plurality of pattern data items for a plurality of gradation levels, each of the pattern data items defining a plurality of binary display patterns set for a plurality of basic frames, and each of the binary display patterns being defined by a plurality of basic pixels; and a selector section configured to select one of the pattern data items, which corresponds to a designated gradation level, wherein the number of the basic frames and the number of the basic pixels for each of the gradation levels are predetermined and depend on each of the gradation levels, and wherein the number of gradation levels of an image to be displayed on the liquid crystal display panel is N, and common pattern data item is used for a gradation level expressed by c and for a gradation level expressed by N−c, where c is an integer larger than 0 and smaller than N/2.

* * * * *